United States Patent [19]

Charvet

[11] Patent Number: 4,756,151

[45] Date of Patent: Jul. 12, 1988

[54] ASSEMBLY OF REINFORCEMENT CORDS FOR PLASTIC AND/OR RUBBER MATERIALS HAVING A CORE AND ARTICLE REINFORCED THEREBY

[75] Inventor: Jean-Louis Charvet, Clermont-Ferrand, France

[73] Assignee: Compagnie Generale des Etablissements Michelin, Clermont-Ferrand, France

[21] Appl. No.: 94,655

[22] Filed: Sep. 9, 1987

[30] Foreign Application Priority Data

Sep. 15, 1986 [FR] France ..... 86 12966

[51] Int. Cl.[4] ..... D02G 3/48; D07B 1/06; B60C 9/00

[52] U.S. Cl. ..... 57/213; 57/212; 57/214; 57/217; 57/902; 152/451; 152/527

[58] Field of Search ..... 57/212–217, 57/218, 902; 152/451, 527, 556, 557

[56] References Cited

U.S. PATENT DOCUMENTS

| | | | |
|---|---|---|---|
| 4,158,946 | 6/1979 | Bourgois | 57/213 |
| 4,333,306 | 6/1982 | Yamashita et al. | 57/217 X |
| 4,470,249 | 9/1984 | Chiappetta et al. | 57/213 |
| 4,543,298 | 9/1985 | Riedl | 57/902 X |
| 4,608,817 | 9/1986 | Brandyberry et al. | 57/902 X |
| 4,651,513 | 3/1987 | Dambre | 152/451 X |

FOREIGN PATENT DOCUMENTS

| | | |
|---|---|---|
| 0168858 | 1/1986 | European Pat. Off. . |
| 0176139 | 4/1986 | European Pat. Off. . |
| 2132243 | 7/1984 | United Kingdom . |

*Primary Examiner*—John Petrakes
*Attorney, Agent, or Firm*—Brumbaugh, Graves, Donohue & Raymond

[57] ABSTRACT

A reinforcement assembly to be impregnated with a plastic or rubber material for reinforcing an article, such as a pneumatic tire, the assembly having three layers of cords: a core layer, an intermediate layer and an outer layer. The intermediate layer and the outer layer have the same direction of winding and the same pitch. When the core layer is wound in the same direction as the intermediate layer, the pitches of these layers differ in such a manner that the ratio between the difference in the values of these two pitches and the larger value of these two pitches is at least equal to 0.30. In the intermediate layer the axis of each cord is arranged along a helix such that the ratio between the radius of curvature of said helix and the diameter of said cord is less than 75.

11 Claims, 4 Drawing Sheets

ASSEMBLY OF REINFORCEMENT CORDS FOR PLASTIC AND/OR RUBBER MATERIALS HAVING A CORE AND ARTICLE REINFORCED THEREBY

BACKGROUND OF THE INVENTION

The present invention relates to assemblies of cords used to reinforce plastic and/or rubber materials and to articles, such as reinforcement plies, belts, tubes and pneumatic tires which embody such reinforcement assemblies.

It is well known that when these assemblies have a complex structure formed at least in part by a core and two layers surrounding said core, it is difficult to achieve a uniform, compact structure for the following reasons: either the imbricating of the cords of one layer in another layer is excessive or the space available for the cords of the outer layer is insufficient. In both cases this results in a disorganization of the assembly since certain cords have an unstable condition. Upon the production of articles by the combining of these assemblies with plastic and/or rubber materials, in particular by a calendaring operation, the pressure exerted on the assembly causes a displacement of these unstable cords the length of which becomes excessive, resulting in the formation of intermittent loops and poor dynamic behavior of the articles. Moreover, this disorganization adversely affects the mechanical properties of the assembly as the result of a non-uniform distribution of the stresses.

The object of the invention is to avoid these drawbacks. Toward this end, the reinforcement assembly according to the invention is characterized by the following features when it is so arranged that its axis is rectilinear:

(a) it has a core formed of a layer of cords or of a center surrounded by a layer of cords, said layer of cords being referred to as the "core layer" in both cases;

(b) it has two adjacent layers of cords surrounding the core layer, the layer closest to the core being referred to as the "intermediate layer" and the layer furthermost from the core being called the "outer layer";

(c) the intermediate layer and the outer layer are each formed of cords wound around the axis of the assembly in the same direction and with the same pitch;

(d) the intermediate layer and the outer layer have the same direction of winding and the same pitch;

(e) the core layer is formed of cords which are:
parallel to the axis of the assembly; or
wound around the axis of the assembly in the same direction and with the same pitch, the directions of winding of the core layer and the intermediate layer being opposite; or
wound around the axis of the assembly in the same direction and with the same pitch, this direction being the same as that of the intermediate layer, the core layer and the intermediate layer having pitches which differ in such a manner that the ratio between the difference in the values of these two pitches to the larger value of these two pitches is equal to at least to 0.30;

(f) the cords of each layer have the same diameter;

(g) in the intermediate layer, the axis of each cord is disposed substantially around the axis of the assembly along a helix such that the ratio between the radius of curvature of said helix and the diameter of said cord is less than 75;

(h) the intermediate layer includes a residual space, the ratio between the size of said residual space and the diameter of the cords of the outer layer being at least equal to 0.30 and at most equal to 0.45;

(i) the number of cords of the outer layer is at least 15.

The following description with reference to the drawings illustrates the invention and facilitates an understanding of it, without limiting its scope.

DETAILED DESCRIPTION OF THE INVENTION

Figure 1:
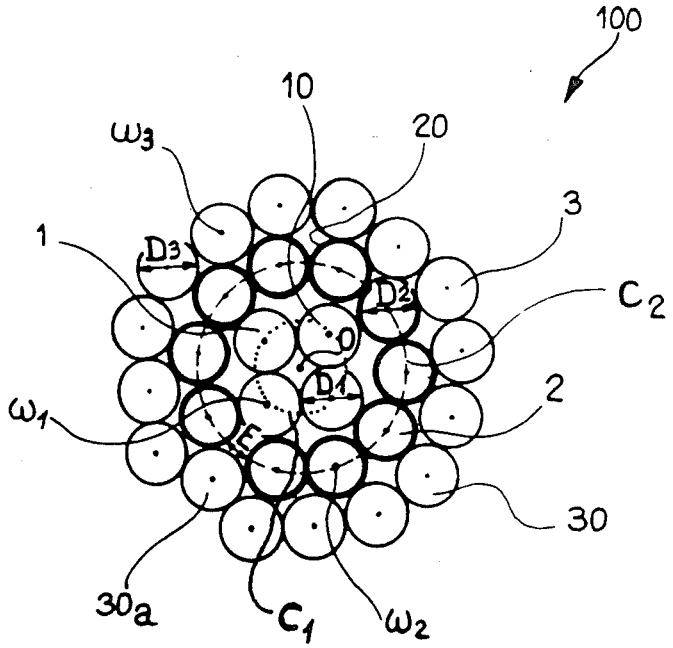
FIG. 1 is a cross-section view of a reinforcement assembly according to the invention taken perpendicular to the axis of the assembly.

FIG. 1 shows an assembly 100 which embodies the invention made up of three layers of cords 1, 2, 3. The layer 1 constitutes the core of the assembly and is formed by the cords 10. The layer 2 is the intermediate layer and is formed by the cords 20. The layer 3 is the outer layer and is formed by the cords 30.

The adjacent layers 2, 3 surround the core layer 1. The intermediate layer 2 is closer to the core and the outer layer 3 is further from the core, and it surrounds the intermediate layer 2.

In each of the three layers 1, 2, 3, the corresponding cords 10, 20, 30 are wound around the rectilinear axis 0 of the assembly in the same direction and with the same pitch.

The expression "pitch of the layer" represents for each layer 1, 2, 3 the length of the winding pitch of the cords 10, 20, 30 in said layer. The pitch of the layer 1 is represented by $p_1$, the pitch of the layer 2 is represented by $p_2$, and the pitch of the layer 3 is represented by $p_3$. The intermediate layer 2 and the outer layer 3 have the same direction of winding and the same pitch, namely, $p_2=p_3$.

The core layer 1 and the intermediate layer 2 are wound in the same direction, but their pitches $p_1$ and $p_2$ are different. This difference is such that the ratio between the difference in the values of these two pitches and the larger of these two pitches is equal to at least 0.30. By way of example, if the pitch $p_2$ has a larger value than the pitch $p_1$, therefore, $(p_2-p_1)/p_2 \geqq 0.30$.

The cords of each layer have the same diameter, the cords 10 of the core layer 1 having the diameter $D_1$, the cords 20 of the intermediate layer 2 having the diameter $D_2$ and the cords 30 of the outer layer 3 having the diameter $D_3$.

In the intermediate layer 2, the axis of each cord 20 is substantially disposed around the axis of the assembly 100 along a helix such that the ratio between the radius of curvature of said helix and the diameter of said cord is less than 75.

Figure 2:
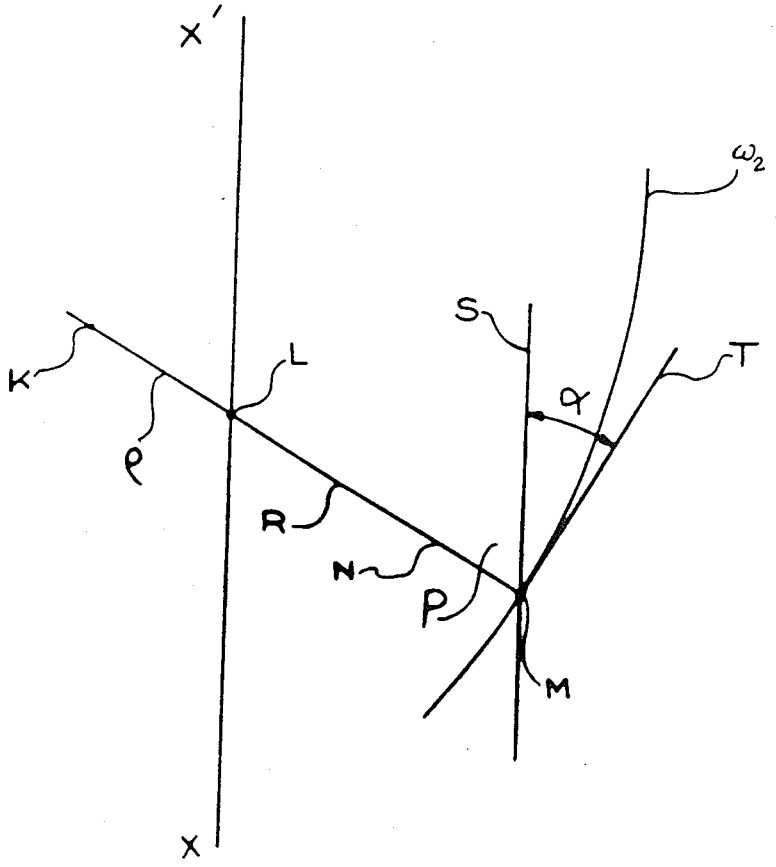
FIG. 2 is a schematic view of the helix described by the axis of a cord of the intermediate layer of the assembly shown in FIG. 1.

FIG. 2 shows a portion of the axis $\omega_2$ of a cord 20. This axis $\omega_2$ is wound helically around the axis XX', assumed rectilinear, of the assembly 100. M represents a point on said helix, T represents the tangent to the helix at the point M, N represents the normal to the helix at the point M, N intersects the axis XX' at the point L and is perpendicular to said axis, P represents the osculating plane of the helix at the point M, the tangent T and the normal N being located in said plane P; K represents the center of curvature of the helix at the point M and $\rho$ the radius of curvature of the helix at the point M, that is to say, the distance KM. The helix $\omega_2$ is a circular helix, that is to say, it is tangent to a cylinder of revolution of axis XX' called the "envelope cylinder", the section of which through a plane perpendicular to the axis XX' is a circle. The radius of curvature $\rho$, therefore, has a constant value whatever the point M. S represents the straight line passing through M, parallel to the axis XX', S and N being perpendicular. The acute angle $\alpha$ defined at M by the lines T and S is the angle of the helix $\omega_2$ with the relationship $\rho=R/\sin^2\alpha$, R being the distance from M to the axis XX', that is to say, the distance LM and therefore the radius of the envelope cylinder. In accordance with the invention, therefore, $\rho/D_2<75$.

For simplicity in the drawing, the envelope cylinder has not been shown in FIG. 2. In FIG. 1, the axes of the cords 10 are represented by $\omega_1$, the axes of the cords 20 by $\omega_2$ and the axes of the cords 30 by $\omega_3$.

Figure 3:
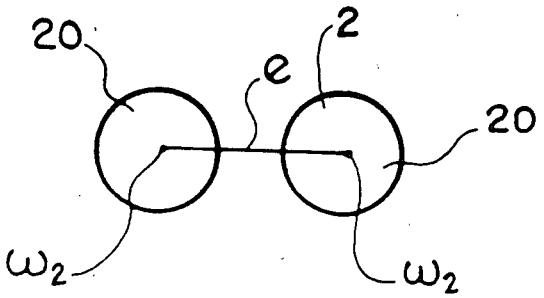
FIG. 3 shows, in cross section, a space between two cords of the intermediate layer of the assembly shown in FIG. 1.

FIG. 3 shows, in a plane perpendicular to the axis XX', assumed rectilinear, of the assembly 100, a section through two adjacent cords 20 in the intermediate layer 2. These two cords 20 are separated by a free space "e" measured along the straight line connecting the axes $\omega_2$ of these two cords. By definition, the residual space E is the sum of all the free spaces "e" measured in any plane perpendicular to the axis XX', assumed rectilinear, of the assembly 100.

The ratio between the size of this residual space E and the diameter $D_3$ of the cords of the outer layer 3 is always equal to at least 0.30 and at most 0.45, that is to say, whatever the plane perpendicular to the axis XX' in which the residual space E is measured, the relationship is:

$$0.30 \leqq E/D_3 \leqq 0.45.$$

In FIG. 1, all the cords 20 of the intermediate layer 2 are shown in contact with each other except for two of these cords, the residual space E then corresponding to the free space between these two cords.

The residual space E can be calculated in the following manner. Let $N_2$ be the number given by the relationship:

$$N_2=\pi/\arcsin(D_2/2R\cos\alpha),$$

arc sin $(D_2/2R\cos\alpha)$ being expressed in radians, $D_2$, R, and $\alpha$ having the meanings given previously.

There is also the relationship:

$$N_2=n_2+E,$$

in which $n_2$ is the whole part of $N_2$ and corresponds to the effective number of cords 20 in the intermediate layer 2 while the residual space E corresponds to the decimal part of $N_2$.

By way of example, the assembly 100 has the following characteristics, the axis XX' being assumed rectilinear:

- the core layer 1 is formed of four cords 10, the intermediate layer 2 is formed of ten cords 20 and the outer layer 3 is formed of 16 cords 30; the assembly 100 therefore has the formula 4+10+16; all the threads 10, 20, 30 are wound in the same direction around the axis XX' of the assembly, for instance towards the left, that is to say, in the S direction;
- the pitches $p_1$, $p_2$, $p_3$ are as follows: $p_1=5.5$ mm; $p_2=p_3=11$ mm; therefore, there is the relationship:

$$(p_2-p_1)/p_2=0.50;$$

- all the cords 10, 20, 30 are steel wires of the same diameter D=0.18 mm; therefore, $D_1=D_2D_3=D=0.18$ mm;
- in the intermediate layer 2, the radius of curvature $\rho$ of the axis $\omega_2$ of the cords 20 is equal to 10.3 mm; therefore, $\rho/D_2=57$;
- the residual space E is practically always equal to 0.07 mm, that is to say, for any plane perpendicular to the axis XX' of the assembly 100 one has substantially $E/D_3=0.39$.

The precise combination of features (a) to (i) in accordance with the invention makes it possible to obtain the following advantages for the assembly 100.

The value of the ratio $\rho/D_2$ and of the ratio $(p_2-p_1)/p_2$ makes it possible for the intermediate layer 2 to have its cords 20 distributed very uniformly around the core layer 1; in every plane perpendicular to the axis XX', the axes $\omega_2$ of said cords 20 are substantially distributed over a circle $C_2$ of center 0 (FIG. 1), the radius of this circle $C_2$ being substantially constant, whatever the plane.

The equality of the pitches $p_2-p_3$ and the well defined limits assigned to the ratio $E/D_3$ permit the two layers 2, 3 to form a uniform assembly with a slight imbrication of a cord 30 of the outer layer 3 in the intermediate layer 2 when the residual space E is located solely between two cords 20 of this layer. In FIG. 1, this imbricated cord is designated 30*a*. The assembly 100, therefore, has a compact structure along its entire axis and its structure is geometrically stable even after the production of an article by the combining of this assembly 100 with a plastic and/or rubber material, in particular by calendaring. This geometrical stability assures a uniform distribution of the stresses in the use of the assembly 100, as well as good dynamic behavior of the article.

This assembly 100 can be used in pneumatic tires. It is particularly adapted for the production of tire carcasses of vehicle tires intended for heavy vehicles or for earth moving vehicles, but it can also be used for other purposes, for instance in order to produce tread reinforcements of pneumatic tires.

Figure 4:
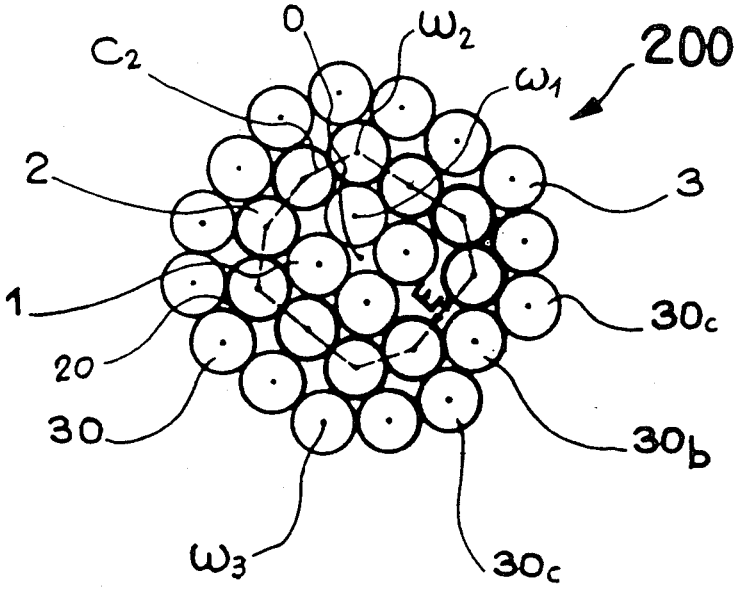
FIGS. 4 and 5 are cross section views of reinforcement assemblies which are not in accord with the invention.

FIG. 4 shows an example of an assembly 200 which is not in accord with the invention, this figure being a section similar to FIG. 1, that is to say, perpendicular to the axis of this assembly, this axis being represented by the point 0 in FIG. 4. This assembly 200, like the assembly 100, has the formula 4+10+16. All the steel cords 10, 20, 30 are wound in the same direction around the axis, but it has the following differences from the assembly 100:

- all the cords 10, 20, 30 are steel wires with a diameter of 0.22 mm;

the pitches satisfy the following relations: $p_1=9$ mm; $p_2=p_3=18$ mm;

the radius of curvature $\rho$ of the axis $\omega_2$ of the cords 20 is equal to 22 mm, that is to say, there is the ratio $\rho/D_2=100$;

the residual space E is equal to 0.11 mm, that is to say, there is the ratio $E/D_3=0.50$.

As a result of the excessive value of $\rho$ and an excessive imbrication of the cords 20 in the core layer 1, the line $C_2$ connecting the axes $\omega_2$ of the cords 20 does not form a uniform circle in all the planes perpendicular to the axis 0, and this although there is the relationship $(p_2-p_1)/p_2=0.50$.

Furthermore, since the ratio $E/D_3$ is greater than 0.45, excessive imbrication takes place of an outer cord 30 into the intermediate layer 2, this imbricated cord being designated **30*b* in FIG. 4**.

Upon the production of an article by the combining of this assembly 200 with a plastic and/or rubber material, in particular by calendaring, the pressure then exerted on the assembly 200 accentuates the imbrication of this cord **30*b* which moves into the intermediate layer 2. The two cords 30*c* which are adjacent to this cord 30*b* are therefore no longer held laterally in the outer layer by the cord 30*b* in view of its imbrication. The assembly 200 is then not geometrically stable and the two cords 30*c* move laterally under the effect of the pressure exerted in the production of the article, these two cords 30*c* assuming a position such that their length becomes excessive, this excessive length leading to the intermittent formation of loops. These geometrical irregularities lead to a heterogenous distribution of the stresses in the use of the assembly 200**, and to poor dynamic behavior of the article.

Figure 5:
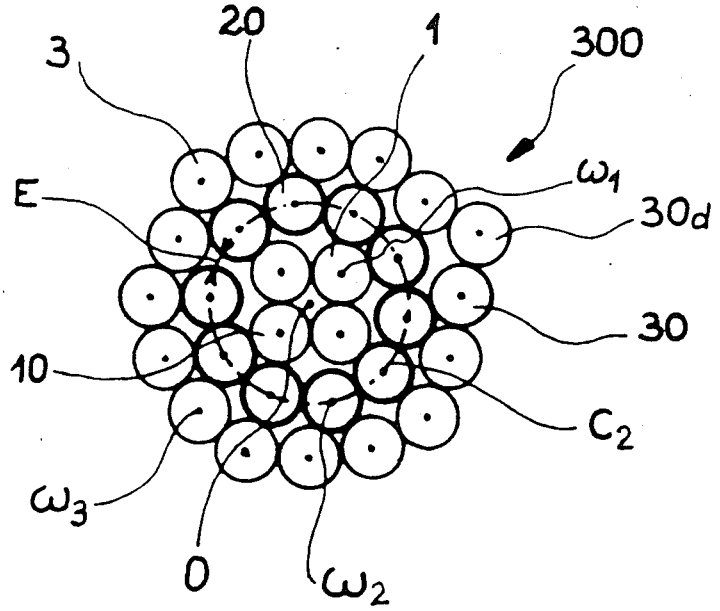

FIG. 5 shows another assembly 300 which is not in accord with the invention, this figure being a section similar to FIG. 1, that is to say, perpendicular to the axis of the assembly, the axis being represented by the point 0 in FIG. 5.

This assembly 300, like the assembly 100, has the formula 4+10+16, all the steel wires 10, 20, 30 having a diameter 0.18 mm and being wound in the same direction around the axis, but it has the following differences form the assembly 100:

the pitches satisfy the following relations: $p_1=4$ mm; $p_2=p_3=8$ mm;

the radius of curvature $\rho$ of the axis $\omega_2$ of the cords 20 is equal to 5.6 mm, that is to say, there is the ratio $\rho/D_2=31$;

the residual space E is equal to 0.05 mm, that is to say, there is the ratio $E/D_3=0.28$.

In view of the values of the ratios $\rho/D_2$ and $(p_2-p_1)/p_2$, the line $C_2$ joining the axes $\omega_2$ is a circle of substantially constant radius, whatever the plane of FIG. 5. However, the ratio $E/D_3$ is less than 0.30 which leads to the following drawbacks as a result of the large number of cords 30 in the outer layer 3 and the fact that the pitches $p_2$ and $p_3$ are equal. One of these cords 30, marked **30*d* in FIG. 5, no longer finds room within the outer layer 3 and no longer rests against the cords 20 of the intermediate layer 2. The assembly 300 is, therefore, not compact. Upon the production of an article by combining this assembly 300 with a plastic and/or rubber material, in particular by calendaring, the pressure then exerted on the assembly 300 tends to move the cord 30*d* towards the intermediate layer 2 and the length of this cord 30*d* becomes excessive, this excessive length leading to the intermittent formation of loops and therefore to the drawbacks previously described in connection with the assembly 200**.

Since the invention is not limited to the examples described above, the assembly in accordance with the invention can, for instance, have the following features:

windings effected in different directions for the core layer and the intermediate layer, in which case it is not necessary that the pitches differ for these two layers but preferably the winding is effected in the same direction for these two layers, as previously described in order to simplify the production of the assemblies and improve their mechanical properties; it should furthermore be noted that the pitch of the intermediate layer may be less than the pitch of the core layer when these two layers are wound in the same direction;

core layer formed of cords parallel to the axis;

diameter of the cords varying from one layer to the next;

core comprising a center surrounded by the core layer, the center being possibly formed by one or more cords;

formula different from 4+10+16.

Preferably, in a section perpendicular to the axis of an assembly in accordance with the invention, the axes $\omega_1$ of the cords 10 of the core layer 1 are arranged substantially on a circle $C_1$, shown in dotted line in FIG. 1, which improves the geometrical uniformity.

The assemblies in accordance with the present invention may possibly have hoopings. Such a hooping is formed, in known manner, by a cord, in particular a metal wire, wound around an assembly with the formation of non-adjacent turns, the hooping having preferably a pitch shorter than that of the outer layer of the assembly and a direction of winding opposite that of said outer layer.

Furthermore, assemblies in accordance with the invention may possibly be associated with other reinforcement elements; thus, for instance, the assemblies in accordance with the invention may constitute cores around which reinforcement cords or strands are disposed to produce complex reinforcement assemblies.

Furthermore, the assemblies in accordance with the invention may be impregnated with a plastic or rubber material.

I claim:

1. A reinforcement assembly comprising a core layer and two adjacent layers of cords surrounding the core layer, an intermediate layer closer to the core and an outer layer, said reinforcement assembly being characterized by the following features when it is so arranged that its axis is rectilinear:

(a) the intermediate layer and the outer layer are each formed of cords wound around the axis of the assembly in the same direction and with the same pitch;

(b) the intermediate layer and the outer layer have the same direction of winding and the same pitch;

(c) the core layer is formed of cords;

(d) the cords of each layer have the same diameter;

(e) the axis of each cord in the intermediate layer is substantially disposed around the axis of the assembly along a helix such that the ratio between the radius of curvature of said helix and the diameter of said cord is less than 75;

(f) the intermediate layer includes a residual space, the ratio between the size of said residual space and the diameter of the cords of the outer layer being equal to at least 0.30 and at most 0.45; and (g) the number of cords in the outer layer is at least equal to 15.

2. A reinforcement assembly as set forth in claim 1 in which the core layer is formed of a layer of cords.

3. A reinforcement assembly as set forth in claim 1 in which the core layer is formed by a center surrounded by a layer of cords.

4. A reinforcement assembly as set forth in claim 1 in which the core layer is formed of cords which are parallel to the axis of the assembly.

5. A reinforcement assembly as set forth in claim 1 in which the core layer is formed of cords which are wound around the axis of the assembly in the same direction and with the same pitch, the direction of winding of the core layer and of the intermediate layer being opposite.

6. A reinforcement assembly as set forth in claim 1 in which the core layer is formed of cords which are wound around the axis of the assembly in the same direction and with the same pitch, this direction being the same as that of the intermediate layer, the core layer and the intermediate layer having pitches which differ in such a manner that the ratio between the difference of these two pitches and the larger of these two pitches is at least equal to 0.30.

7. A reinforcement assembly according to claim 1, characterized by the fact that the cords of the core layer, the intermediate layer and the outer layer all have the same diameter.

8. A reinforcement assembly according to claim 1, characterized by the fact that the core is formed of a core of four cords, the intermediate layer is formed of 10 cords and the outer layer is formed of 16 cords.

9. A reinforcement assembly according to claim 1, characterized by the fact that it is impregnated with a plastic or rubber material.

10. An article reinforced by the assembly according to claim 1.

11. An article according to claim 10, characterized by the fact it is a pneumatic tire.

* * * * *